US006699109B1

(12) United States Patent
Fox et al.

(10) Patent No.: US 6,699,109 B1
(45) Date of Patent: Mar. 2, 2004

(54) APPARATUS AND METHOD OF REMOVING ABRADABLE MATERIAL FROM A TURBOMACHINE FAN CONTAINMENT CASE

(75) Inventors: Michael Dean Fox, Liberty Township, OH (US); Terry Joe Bruner, Geuda Springs, KS (US); Robert Thomas Ford, Abilene, KS (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/064,896

(22) Filed: Aug. 27, 2002

(51) Int. Cl.[7] ..... B24C 3/06
(52) U.S. Cl. ..... 451/92; 451/38
(58) Field of Search ..... 451/38, 39, 75, 451/76, 87, 91, 88, 92, 99; 901/41

(56) References Cited

U.S. PATENT DOCUMENTS 5,540,172 A * 7/1996 Goldbach et al. ..... 114/222
5,715,852 A * 2/1998 Jepsen ..... 134/167 R
6,464,569 B1 * 10/2002 Thierer ..... 451/92

* cited by examiner

*Primary Examiner*—Dung Van Nguyen
(74) *Attorney, Agent, or Firm*—David L. Narciso; Gary M. Hartman; Domenica N.S. Hartman

(57) ABSTRACT

An apparatus (10) and method for removing an abradable material from an interior surface (16) of a fan containment case (14), without requiring removal of the fan containment case (14) from its engine (12). The apparatus (10) and method generally involve adjusting the elevation of a blast head (40) and centering a horizontal axis of rotation thereof with the fan containment case (14) to position the blast head (40) adjacent the abradable material on the case surface (16). An erosion media is then sprayed with the blast head (40) in a substantially radial direction relative to the horizontal axis of rotation of the blast head (40), such that the erosion media impacts and erodes the abradable material. The blast head (40) is rotated about the horizontal axis of rotation thereof so that the erosion media is sprayed at the abradable material along the entire circumference of the fan containment case (14).

26 Claims, 6 Drawing Sheets

APPARATUS AND METHOD OF REMOVING ABRADABLE MATERIAL FROM A TURBOMACHINE FAN CONTAINMENT CASE

BACKGROUND OF INVENTION

1. Field of the Invention

The present invention generally relates to fan containment assemblies for turbomachinery, such as gas turbine engines. More particularly, this invention relates to an automated apparatus and method for removing an abradable material for a fan containment assembly.

2. Description of the Related Art

Gas turbine engines generally operate on the principle of compressing air within a compressor section of the engine, and then delivering the compressed air to the combustion section of the engine where fuel is added to the air and ignited. Afterwards, the resulting combustion mixture is delivered to the turbine section of the engine, where a portion of the energy generated by the combustion process is extracted by a turbine to drive the engine compressor. High bypass turbofan engines, widely used for high performance aircraft which operate at subsonic speeds, have a large fan placed at the front of the engine to produce greater thrust and reduce specific fuel consumption. The fan compresses the incoming air, a portion of which is then delivered to the combustion chamber, though a larger portion is bypassed to the rear of the engine to generate additional engine thrust.

The fan is circumscribed by a fan containment case such that the case is immediately adjacent the tips of the fan blades. The containment case serves to channel incoming air through the fan so as to ensure that the bulk of the air entering the engine will be compressed by the fan. However, a small portion of the air is able to bypass the fan blades through a radial gap present between the fan blade tips and the containment case. Because the air compressed by the fan blades is used to generate thrust and feed the turbine section of the engine, engine efficiency can be increased by limiting the amount of air which is able to bypass the fan blades through this gap. Accordingly, the fan and containment case are manufactured to close tolerances in order to minimize the gap. However, manufacturing tolerances, differing rates of thermal expansion and dynamic effects limit the extent to which this gap can be reduced. Furthermore, during the normal operation of an aircraft turbofan engine, the fan blades may rub the containment case as a result of a hard landing or a hard maneuver of the aircraft. Any rubbing contact between the fan blade tips and the containment case will abrade the tips of the rotors, tending to further increase the gap between the containment case and blade tips, thereby reducing engine efficiency. The fan is circumscribed by a fan containment case such that the case is immediately adjacent the tips of the fan blades. The containment case serves to channel incoming air through the fan so as to ensure that the bulk of the air entering the engine will be compressed by the fan. However, a small portion of the air is able to bypass the fan blades through a radial gap present between the fan blade tips and the containment case. Because the air compressed by the fan blades is used to generate thrust and feed the turbine section of the engine, engine efficiency can be increased by limiting the amount of air which is able to bypass the fan blades through this gap. Accordingly, the fan and containment case are manufactured to close tolerances in order to minimize the gap. However, manufacturing tolerances, differing rates of thermal expansion and dynamic effects limit the extent to which this gap can be reduced. Furthermore, during the normal operation of an aircraft turbofan engine, the fan blades may rub the containment case as a result of a hard landing or a hard maneuver of the aircraft. Any rubbing contact between the fan blade tips and the containment case will abrade the tips of the rotors, tending to further increase the gap between the containment case and blade tips, thereby reducing engine efficiency.

In view of the above, it is well known in the art to cover the portion of the containment case adjacent the blade tips with an abradable material, such that the abradable material will sacrificially abrade away when rubbed by the fan blades. Inherently, as the abradable material is removed, the gap between the blade tips and the surface of the abradable material will increase, necessitating removal and replacement of the abradable material to maintain desirable aerodynamic efficiencies associated with a smooth abradable surface and a small gap between the abradable surface and the fan blade tips. Restoration of the abradable material also becomes necessary if damage has occurred from impacts with foreign objects.

A common technique for removing the abradable material is performed with handheld tools, such as an air chisel, after which sandpaper is used to achieve a smooth surface finish. While suitable for use on steel fan cases, air chisels are too aggressive for use on engines with aluminum cases. Aluminum fan cases must be removed from the fan frame, stripped of gearboxes, wire harnesses, controls, etc., and then centered on a turning machine to remove the old abradable material. Any damage that may occur to the base metal must be repaired before applying and bonding the new abradable material. The removal process can be time consuming and expensive, and requires a large maintenance facility to which at least the front of the engine must be transported for disassembly. Due to the special equipment required to perform the machining operation, a limited number of facilities are available for removing fan case abradable material. As a result, additional costs, scheduling and transport problems are common.

Accordingly, it would be desirable if an improved technique were available by which the abradable material of a fan containment case could be removed without requiring removal of the fan case from the engine, such that restoration can be performed in the field.

SUMMARY OF INVENTION

The present invention provides an apparatus and method for removing an abradable material from an interior surface of a fan containment case, without requiring removal of the fan containment case from its engine, e.g., a high-bypass gas turbine engine. The apparatus of this invention generally includes a frame, and means rotatably mounted to the frame for spraying an erosion media in a substantially radial direction relative to a horizontal axis of rotation of the spraying means. The erosion media impacts the abradable material on the interior surface of the fan containment case while the spraying means is positioned within the fan containment case adjacent the abradable material. The apparatus further includes means rotatably mounted to the frame with the spraying means for retrieving the erosion media after impacting the abradable material. Also provided is means mounted to the frame for centering the horizontal axis of rotation of the spraying means relative to the interior surface of the fan containment case, means for adjusting together the elevation of a horizontal central axis of the centering means and the horizontal axis of rotation of the spraying means relative to the frame, and means for positioning the spraying means adjacent the interior surface of the fan containment case.

A method made possible with the apparatus of this invention generally comprises the steps of adjusting the elevation of the spraying means and centering the horizontal axis of rotation thereof with the fan containment case to position the spraying means adjacent the abradable material on the interior surface of the fan containment case. The erosion media is then sprayed with the spraying means in a substantially radial direction relative to the horizontal axis of rotation of the spraying means, such that the erosion media impacts and erodes the abradable material on the interior surface of the fan containment case. In addition, the spraying means is rotated about the horizontal axis of rotation thereof so that the erosion media is sprayed at the abradable material along the entire circumference of the fan containment case. At the same time, the erosion media is retrieved after being sprayed and impacted against the abradable material.

In view of the above, it can be seen that a significant advantage of this invention is that the apparatus is capable of removing the abradable material from a fan containment case without requiring removal of the case from an engine. Instead, only the fan blades need be removed to gain access to the interior surface of the case. Another advantage of the invention is that the apparatus provides a means by which the spraying means is self-centered with respect to the interior surface of the fan containment case, and the operation of the spraying means can be controlled to follow a specific path along the inner diameter of the fan containment case. As such, the apparatus requires minimal setup, and can be operated in an automated mode without further human supervision. In a preferred embodiment, the apparatus is capable of removing substantially all of the abradable material in roughly a single rotation of the spraying means about its horizontal axis of rotation. With the use of appropriate abradable material and spray pressures, this operation can be completed in about one hour without damaging the substrate beneath the abradable material.

Other objects and advantages of this invention will be better appreciated from the following detailed description.

DETAILED DESCRIPTION

Figure 1:
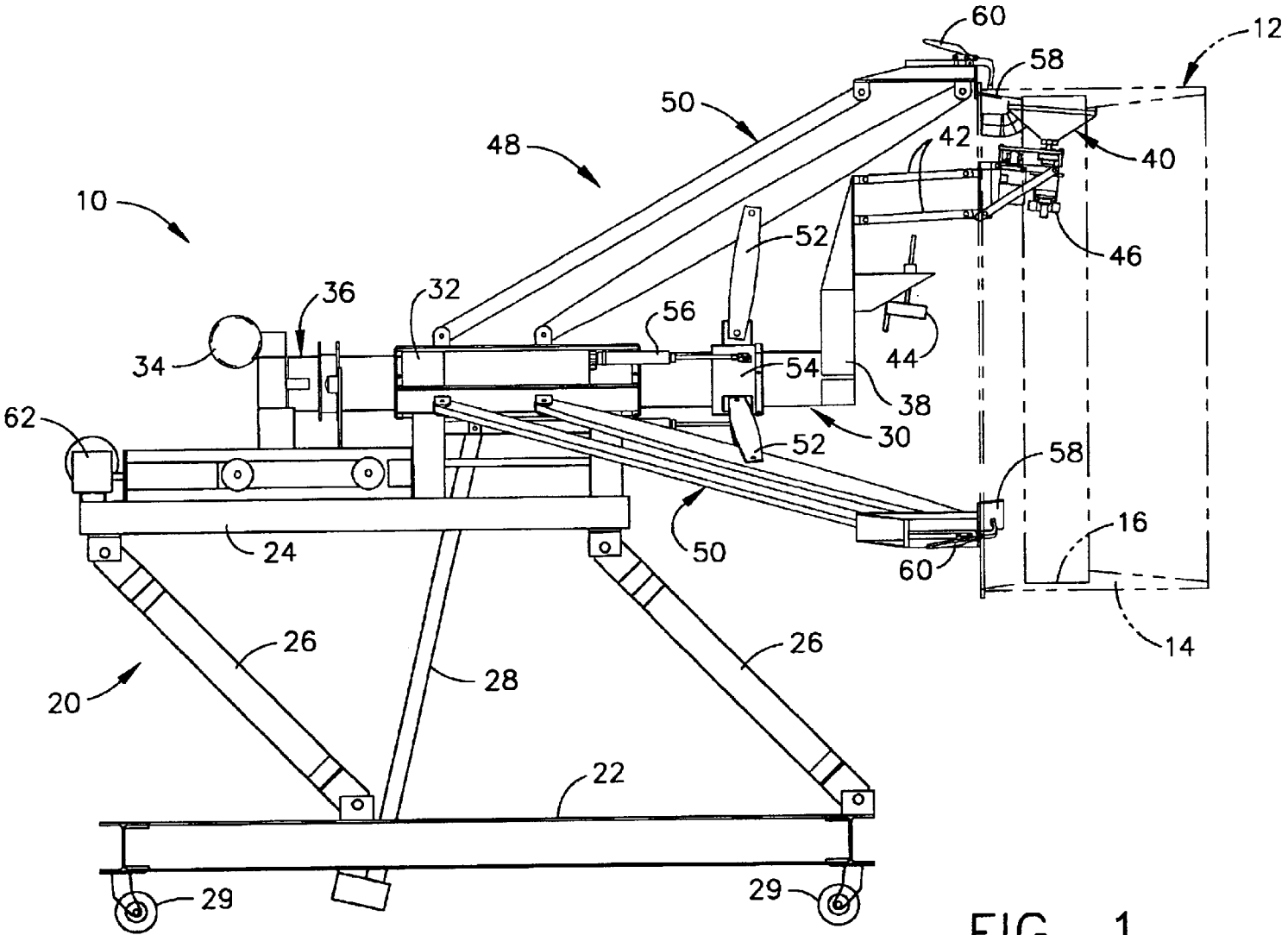
FIG. 1 is a side view of an apparatus for removing abradable material from a fan containment case in accordance with a preferred embodiment of this invention.

FIGS. 1 through 5 represent an apparatus 10 for removing an abradable material in accordance with a preferred embodiment of the invention. The apparatus 10 is particularly adapted for removing an abradable material from the blade containment case of a turbomachine, such as the fan containment case of a high bypass turbofan engine. As known in the art, high bypass turbofan engines have a fan section within which a fan formed by a number of fan blades is mounted to a hub. A fan section 12 is represented in phantom in FIG. 1, and includes a fan containment case 14 that circumscribes the fan (shown removed), and whose radially inward surface has a channel 16 containing an abradable material. Suitable materials for the abradable material include various lightweight materials known and used in the prior art, including composite materials such as an epoxy filled with hollow glass beads. The apparatus 10 of this invention is adapted to remove the abradable material from the case 14 to permit the application of a new layer of abradable material. While the invention can be used to remove abradable material from containment cases formed of a variety of materials, including steel, the invention is particularly well suited for use on aluminum cases that are more prone to damage during removal of the abradable material by conventional methods.

As represented in FIGS. 1 through 5, the apparatus 10 is able to remove the abradable material while the fan containment case 14 remains mounted to the engine. The apparatus 10 is shown as comprising a frame assembly 20 having a base 22, platform 24 and legs 26 pivotably connected to both the base 22 and platform 24. A vertical actuator 28 is mounted to the base 22 and connected to the platform 24 to raise and lower the platform 24 relative to the base 22. The base 22 is shown as being equipped with wheels 29 that enable the apparatus 10 to be moved and positioned in front of the fan section 12. The wheels 29 are preferably equipped with wheel locks (not shown) of any conventional design to prevent movement of the apparatus 10 once positioned.

A shaft assembly 30 is rotatably mounted to the platform 24 in any suitable manner. An electric motor 34 and reduction gear assembly 36 is mounted to the platform 24 for rotating the shaft assembly 30 at an adjustable controlled speed, such as about one rotation per hour, though faster and slower speeds are foreseeable. A radial arm 38 is mounted to the end of the shaft assembly 30 opposite the motor 34, and extends in a radial direction relative to the axis of rotation of the shaft assembly 30. At the distal end of the radial arm 38, a blast head 40 is mounted by a pair of articulating arms 42 whose movement and position, and therefore the radial position of the blast head 40, are controlled with a radial adjustor 44 mounted to the arm 38. As will be discussed in greater detail with respect to FIG. 6, the blast head 40 delivers an erosion media (not shown) for the purpose of removing the abradable material from the fan containment case 14. Finally, the orientation (tilt) of the blast head 40 is adjusted with a tilt adjustor 46, also mounted to the articulating arms 42. With the electric motor 34, the entire assembly—comprising the shaft assembly 30, radial arm 38, arms 42 and blast head 40, etc.—can be caused to rotate about the axis of the shaft assembly 30, which is oriented horizontally in view of the orientation of the engine fan section 12. In this manner, the blast head 40 can be caused to follow the inner circumference of the fan case 14 while spraying the erosion media in a generally radial direction, such that the erosion media impacts the abradable material located on the interior surface of the fan containment case 14, as represented in FIG. 1.

Also shown in FIGS. 1 through 5 is a chuck assembly 48 mounted to a housing 32 that supports the shaft assembly 30. The chuck assembly 48 is shown as comprising three two-bar arm assemblies 50, which as shown in FIG. 1 are adapted to engage the fan containment case 14 and center the shaft assembly 30 with the centerline of the fan section 12. For this purpose, three equiangularly-spaced arm assemblies 50 are preferred, though it is foreseeable that a different number of arms could be used. The arm assemblies 50 are articulated in unison through rods 52 connected to a collar 54 mounted with bearings to the shaft assembly 30. As such, the chuck assembly 48 has a horizontal central axis that substantially coincides with the axis of rotation of the shaft assembly 30. An actuator 56 is coupled to the collar 54 to move the collar 54 axially along a given length of the shaft assembly 30, causing the arm assemblies 50 to pivot in unison toward or away from the axis of rotation of the shaft assembly 30. The distal end 58 of each arm assembly 50 is adapted to engage the interior surface of the fan containment case 14, and is equipped with a clamp 60 for gripping the case 14 with the distal end 58.

Figure 2:
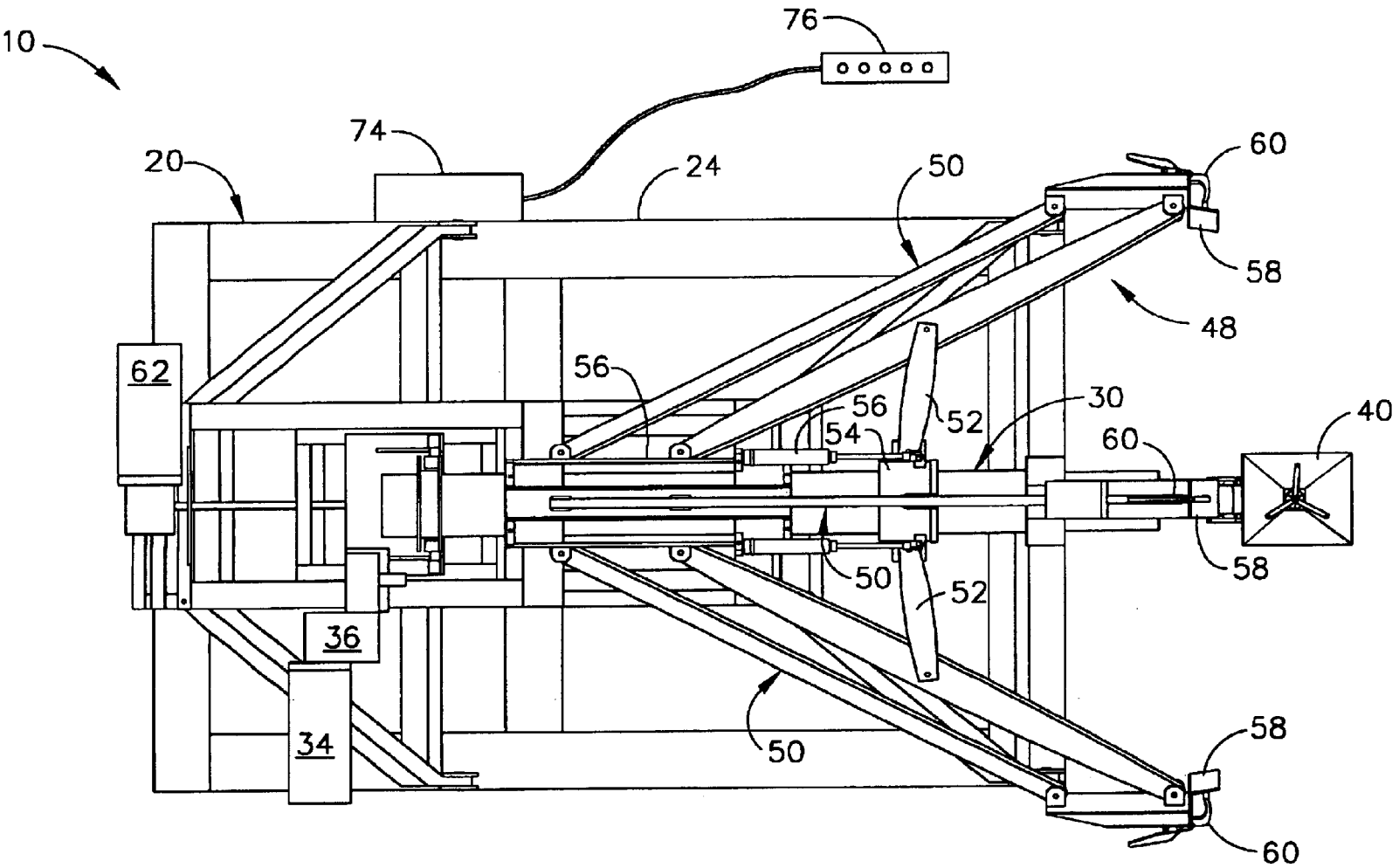
FIGS. 2, 3, 4 and 5 are a top view, front end view, back end view, and perspective view, respectively, of the apparatus of FIG. 1.
Figure 3:
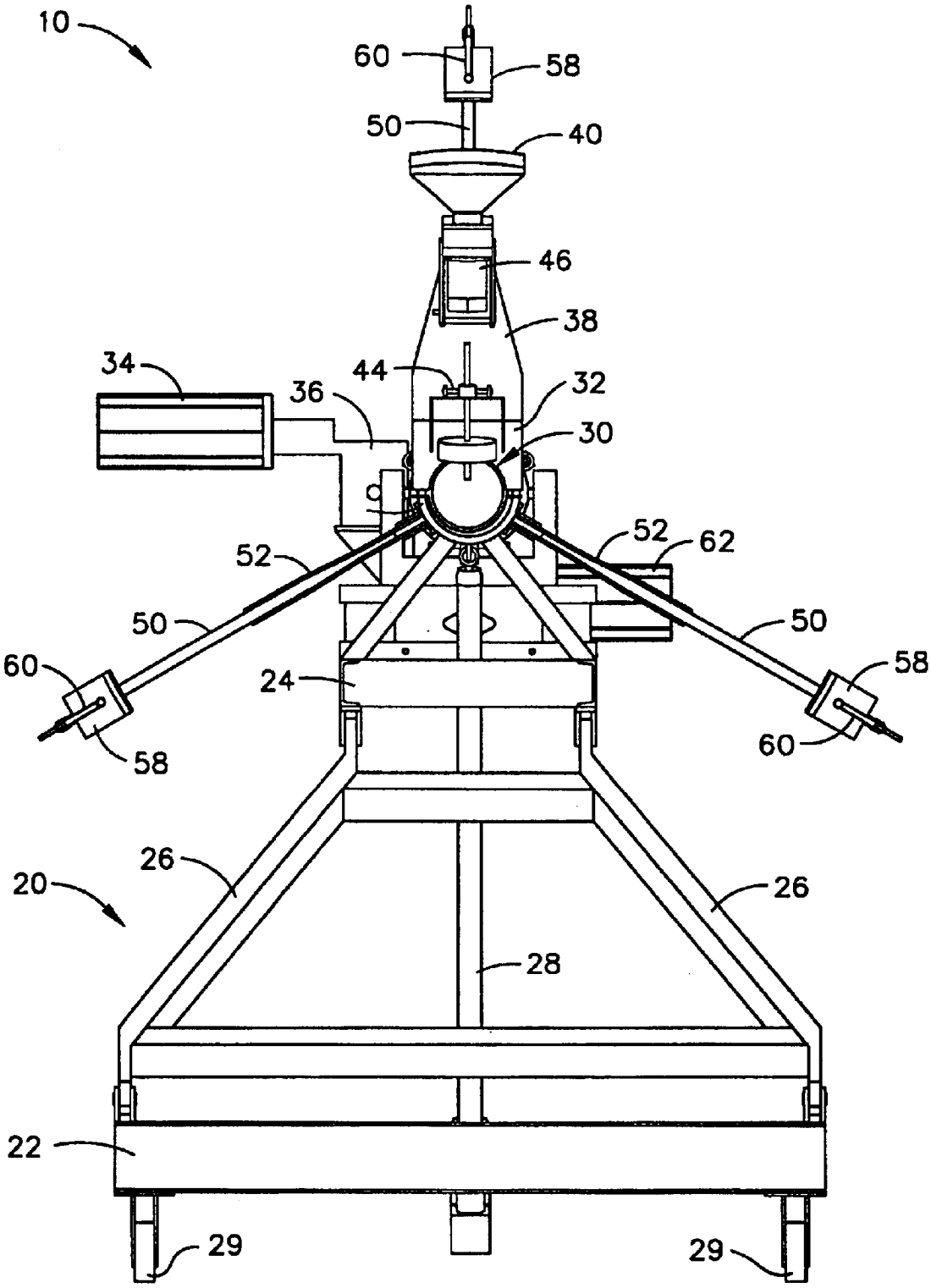
Figure 4:
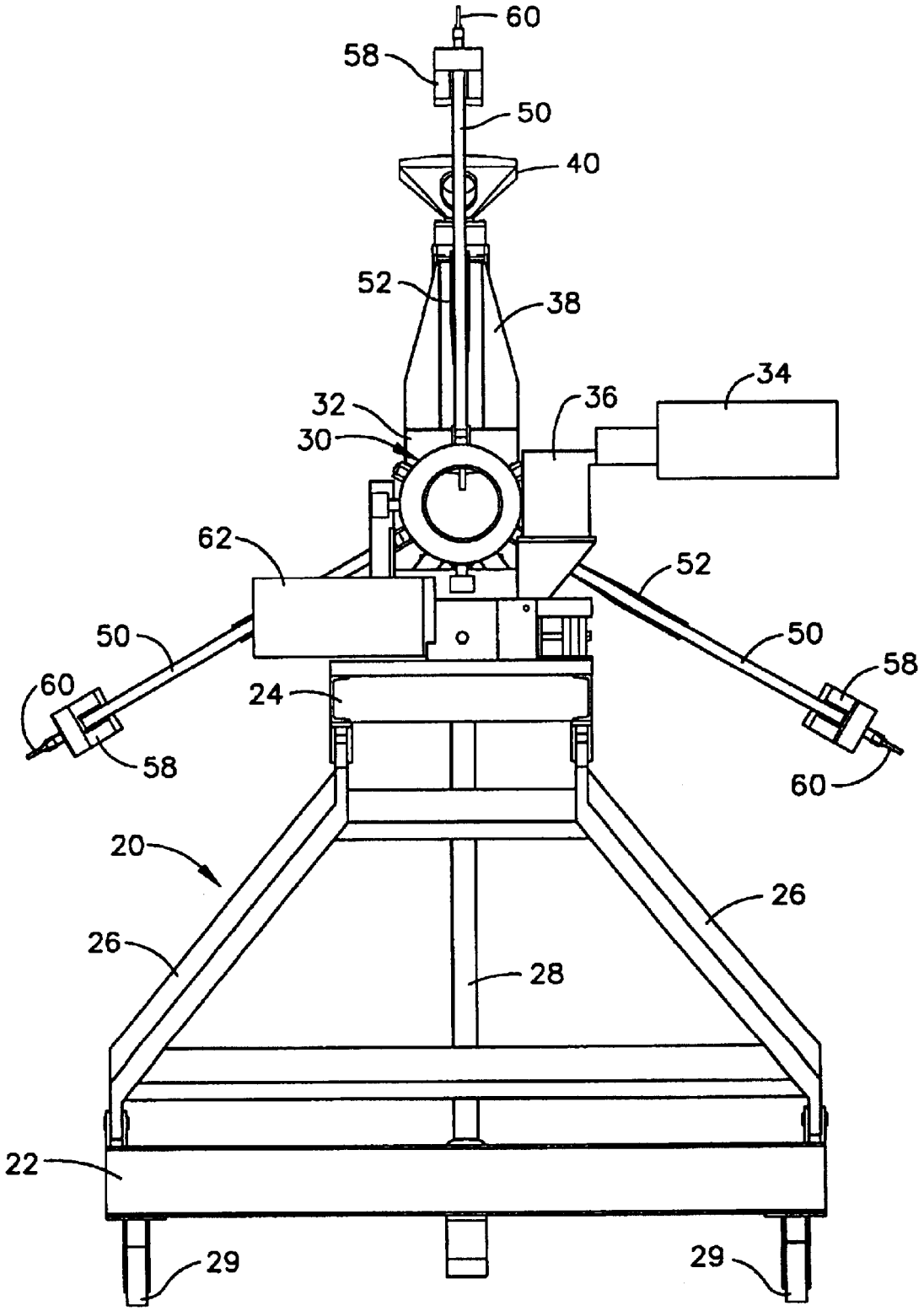
Figure 5:
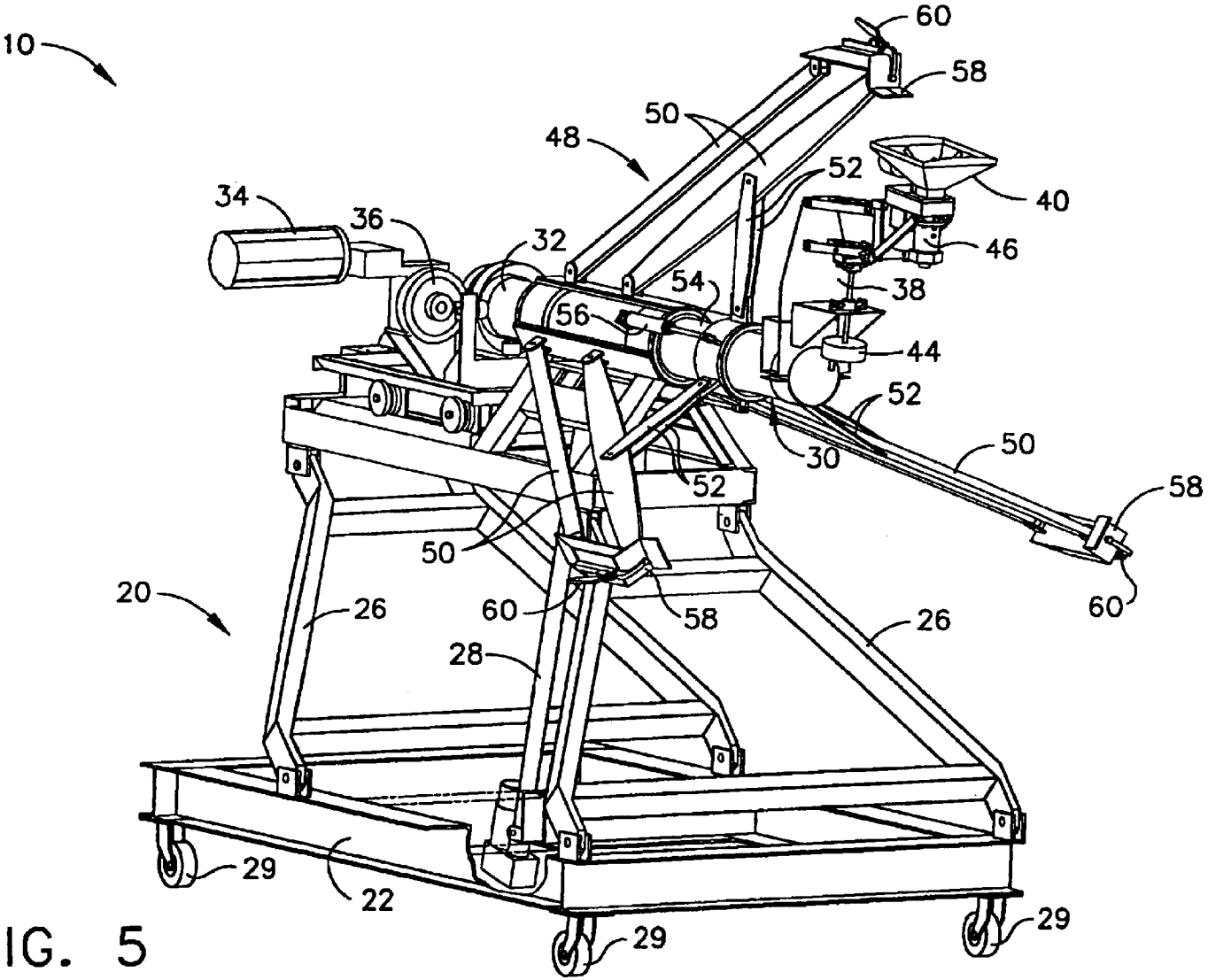

In FIGS. 1 and 2, an actuator 62 is shown with which the shaft assembly 30— and therefore simultaneously the blast head 40 and chuck assembly 48—can be moved axially, i.e., parallel to the axis of rotation of the shaft assembly 30. Consequently, the blast head 40 can be introduced into the fan section 12, positioned in the cross-sectional plane of the case 14 containing the abradable material to perform the removal operation, and later retracted from the fan section 12 at the completion of the operation. Simultaneously with the introduction of the blast head 40 in the fan section 12, the arm assembilies 50 are moved toward the fan section 12. Once the blast head 40 is properly axially positioned within the fan section 12, the arm assemblies 50 can be pivoted radially outward with the actuator 56 to engage the rim of the fan containment case 14 and thereby center the shaft assembly 30 within the fan section 12. Finally, finer adjustments can be made to place the blast head 40 immediately adjacent the abradable material through the radial adjustor 44 and the tilt adjustor 46.

Figure 6:
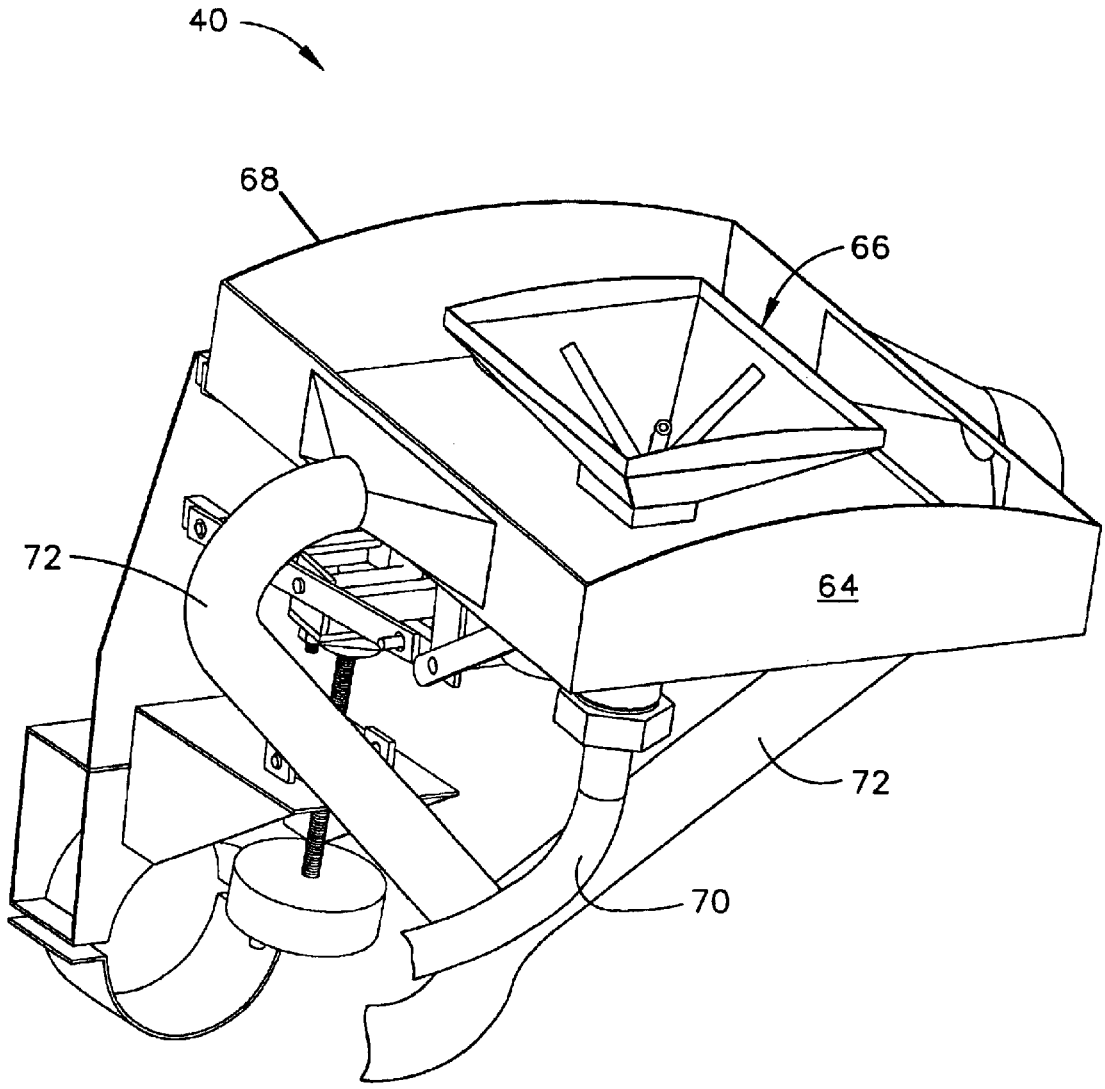
FIG. 6 is a perspective view of a blast head shown mounted to the apparatus of FIG. 1.

The blast head 40 represented in FIGS. 1 through 5 is shown in greater detail in FIG. 6. The blast head 40 can be seen to comprise a containment enclosure 64 for containing the erosion media sprayed through a spray head 66 disposed in a wall of the enclosure 64. The outer surface 68 of the containment enclosure 64 is contoured to correspond to the radius of the fan containment case 14, and is equipped with a rubber or brush seal (not shown) to provide a sealing action with the interior surface of the fan containment case 14. The erosion media is delivered to the spray head 66 through a supply hose 70, and retrieved from the enclosure 64 through a pair of hoses 72 attached to opposite sides of the enclosure 64. As such, the erosion media is retrieved from the containment enclosure 64 after the erosion media is sprayed from the spray head 66 and has impacted the abradable material on the interior surface of the fan containment case 14. Thereafter, the spent erosion media containing particles of the abradable material may be discarded, though in a preferred embodiment the erosion media is separated from particles of the abradable material and reused.

While spray heads 66 of various designs may be used, a preferred spray head 66 is equipped with multiple nozzles, preferably three as shown, that rotate together about the axis along which the media is sprayed. A blast head 40 equipped with the preferred spray head 66 and media retrieval and reclamation system particularly suitable for use with this invention is the MPC Series of machines available from Abrasive Blast Systems, Inc., of Abilene, Kans. An erosion material found to be suitable for use with the apparatus 10 of this invention is a plastic bead material formed of Type II urea formaldehyde thermoset per Mil-P-85291, and therefore commercially available from a number of sources. In practice, a suitable particle size for the Mil-P-85291 media is about twenty to about thirty mesh, though smaller and larger particle sizes could be used. When using this plastic erosion media within the stated particle size range, suitable operating parameters for the blast head 40 include an adjustable supply pressure of about 50 to about 80 psi (about 3.5 to about 5.5 bar), such as about 65 psi (about 4.5 bar). The volumetric airflow rate from the enclosure 64 is preferably slightly higher than the flowrate to the enclosure 64 to promote a vacuuming effect for reclaiming the media from the enclosure 64. With these parameters, abradable material has essentially been completely removed from a fan containment casing with a single complete rotation of the blast assembly 40. Some overlap (e.g., about 370 degrees rotation) is generally desirable to ensure that the entire circumference of the case 14 has been thoroughly treated during the operation.

In the preferred embodiment, the apparatus 10 is capable of being operated within minimal supervision by an operator. For this purpose, the apparatus 10 is preferably equipped with controls that cause the shaft assembly 30 to rotate and the blast head 40 to spray the media according to predetermined settings. Automatic safety stops are preferably provided to stop the operation of the blast head 40 if the shaft assembly 30 stops rotating. In FIG. 2, a control unit 74 is seen mounted to the platform 24 by which the rotational speed of the blast head 40 (through the shaft assembly 30) is controlled. Connected to this unit 74 is a pendant control 76 with switches, etc., for controlling the operation of the chuck assembly 48 and actuators 28, 56 and 62.

In view of the above, the apparatus 10 of this invention can be used to remove abradable material from an interior surface of a fan containment case 14 while the case 14 remains mounted to a high bypass turbofan engine. Prior to the operation, the fan blades are removed from the engine, the platform 24 is raised with the vertical actuator 28 to align the axis of the shaft assembly 30 (and therefore the axis of the chuck assembly 48) with the centerline of the fan section 12. The blast head 40 and arm assemblies 50 can then be introduced into the case 14 by extending the actuator 62. As a result of actuating the actuator 56 to engage the arm assemblies 50 with the rim of the fan containment case 14, the axis of rotation of the shaft assembly 30 is accurately centered with the centerline of the fan containment case 14. The blast head 40 can then be moved in the radial direction with the arms 42 and adjustor 44 until the containment enclosure 64 contacts the interior surface of the case 14 and the spray head 66 is positioned over the abradable material. Thereafter, the spraying operation is commenced, with the blast head 40 closely following the entire inner circumferential surface of the case 14 covered by the abradable material as a result of the operation of the motor 34, controlled with the control unit 74 to rotate the blast head 40 at a predetermined speed. The control unit 74 can also be employed to terminate the flow of erosion media to and from the blast head 40.

While the invention has been described in terms of a preferred embodiment, it is apparent that other forms could be adopted by one skilled in the art. For example, the physical configuration of the apparatus 10 could differ from that shown. Therefore, the scope of the invention is to be limited only by the following claims.

What is claimed is:

1. An apparatus (10) capable of removing abradable material from an interior surface (16) of a fan containment case (14) while the fan containment case (14) remains mounted to an engine (12), the apparatus (10) comprising:

a frame (20);

means (40,66) rotatably mounted to the frame (20) for spraying an erosion media in a radial direction relative to a horizontal axis of rotation of the spraying means (40,66) such that the erosion media impacts the abradable material on the interior surface (16) of the fan containment case (14) when the spraying means (40, 66) is positioned within the fan containment case (14);

means (40,64) rotatably mounted to the frame (20) with the spraying means (40,66) for retrieving the erosion media after the erosion media is sprayed from the spraying means (40,66) and has impacted the abradable material;

means (48) mounted to the frame (20) for centering the horizontal axis of rotation of the spraying means (40, 66) relative to the interior surface (16) of the fan containment case (14), the centering means (48) having a horizontal central axis that substantially coincides with the horizontal axis of rotation of the spraying means (40,66);

means (28) for adjusting together the elevation of the horizontal central axis of the centering means (48) and the horizontal axis of rotation of the spraying means (40,66) relative to the frame (20); and means (42,44,46) for positioning a portion (66) of the spraying means (40,66) adjacent the interior surface (16) of the fan containment case (14).

2. An apparatus (10) according to claim 1, wherein the frame (20) is supported on wheels (29).

3. An apparatus (10) according to claim 1, wherein the centering means (48) comprises three arms (50) coupled together for movement in unison toward and away from the horizontal central axis of the centering means (48).

4. An apparatus (10) according to claim 3, wherein each arm (50) of the centering means (48) has a distal end (58) for engaging the interior surface (16) of the fan containment case (14) and a clamp (60) for gripping the fan containment case (14).

5. An apparatus (10) according to claim 1, further comprising means (62) for moving the spraying means (40,66) in an axial direction along the horizontal axis of rotation thereof.

6. An apparatus (10) according to claim 1, wherein the portion (66) of the spraying means (40,66) positioned adjacent the interior surface (16) of the fan containment case (14) is a spray head (66) comprising multiple nozzles that rotate together about an axis substantially parallel to the radial direction in which the erosion media is sprayed.

7. An apparatus (10) according to claim 1, wherein the portion (66) of the spraying means (40,66) positioned adjacent the interior surface (16) of the fan containment case (14) is a spray head (66), the spraying means (40,66) further comprising a containment enclosure (64) to which the spray head (66) is mounted, the containment enclosure (64) having means for sealing against the interior surface (16) of the fan containment case (14).

8. An apparatus (10) according to claim 7, wherein the retrieving means (40,64) is coupled to the containment enclosure (64), the spray head (66) sprays the erosion media at a first volumetric flowrate, and the retrieving means (40,64) draws the erosion media from the containment enclosure (64) at a second volumetric flowrate that is higher than the first volumetric flowrate.

9. An apparatus (10) according to claim 1, wherein the apparatus (10) is operable to substantially remove the abradable material from the interior surface (16) of the fan containment case (14) in a single rotation of the spraying means (40,66) about the horizontal axis of rotation.

10. An apparatus (10) for removing abradable material from an interior surface (16) of a fan containment case (14) while the fan containment case (14) remains mounted to a high bypass turbofan engine (12), the apparatus (10) comprising:

a frame assembly (20) having a base structure (22) and a platform structure (24);

a shaft (30) rotatably mounted to the platform structure (24);

a radial arm (38) mounted to the shaft (30);

a spray head (66) mounted to the radial arm (38) for spraying an erosion media in a radial direction relative to a horizontal axis of rotation of the shaft (30) such that the erosion media impacts the abradable material on the interior surface (16) of the fan containment case (14) when the spray head (66) is positioned within the fan containment case (14);

a containment enclosure (64) mounted to the radial arm (38) for containing the erosion media sprayed by the spray head (66), the containment enclosure (64) having means for sealing against the interior surface (16) of the fan containment case (14);

means (72) coupled to the containment enclosure (64) for retrieving the erosion media from the containment enclosure (64) after the erosion media is sprayed from the spray head (66) and has impacted the abradable material;

chucking means (48) mounted to the platform structure (24) for centering the horizontal axis of rotation of the shaft (30) relative to the interior surface (16) of the fan containment case (14), the chucking means (48) comprising arms (50) coupled together for movement in unison toward and away from a horizontal central axis of the chucking means (48), the horizontal central axis substantially coinciding with the horizontal axis of rotation of the shaft (30);

means (28) for adjusting the elevation of the platform structure (24) relative to the base structure (22) so as to adjust together the elevation of the horizontal central axis of the chucking means (48) and the horizontal axis of rotation of the shaft (30) relative to the base structure (22);

means (42,44) for adjusting the spray head (66) on the radial arm (38) in the radial direction from the shaft (30); and means (74) for controlling the spraying and rotating steps so as not to require manual control and to continue the spraying and rotating steps while the shaft (30) makes about one complete rotation about the horizontal axis thereof, during which time the abradable material is substantially removed from the interior surface (16) of the fan containment case (14).

11. An apparatus (10) according to claim 10, wherein the frame assembly (20) is supported on wheels (29).

12. An apparatus (10) according to claim 10, wherein each arm (50) of the chucking means (48) has a distal end (58) for engaging the interior surface (16) of the fan containment case (14) and a clamp (60) for gripping the fan containment case (14).

13. An apparatus (10) according to claim 10, further comprising means (62) for moving the radial arm (38) in an axial direction along the horizontal axis of rotation of the shaft (30).

14. An apparatus (10) according to claim 10, wherein the spray head (66) comprises multiple nozzles that rotate together about an axis substantially parallel to the radial direction in which the erosion media is sprayed.

15. A method of removing abradable material from an interior surface (16) of a fan containment case (14), the method comprising the steps of:

providing a spraying means (40,66) rotatably mounted to a frame (20);

adjusting the elevation of the spraying means (40,66) and centering a horizontal axis of rotation of the spraying means (40,66) with the fan containment case (14) to position the spraying means (40,66) adjacent the interior surface (16) of the fan containment case (14);

spraying an erosion media with the spraying means (40, 66) in a radial direction relative to the horizontal axis of rotation of the spraying means (40,66) such that the erosion media impacts and erodes the abradable material on the interior surface (16) of the fan containment case (14);

rotating the spraying means (40,66) about the horizontal axis of rotation thereof so that the erosion media is sprayed at the interior surface (16) of the fan containment case (14) along a circumferential direction thereof; and retrieving the erosion media after the erosion media is sprayed from the spraying means (40,66) and has impacted the abradable material on the interior surface (16) of the fan containment case (14).

16. A method according to claim 15, wherein the step of centering the spraying means (40,66) comprises moving three arms (50) coupled together in unison away from the horizontal axis of rotation of the spraying means (40,66).

17. A method according to claim 16, further comprising the steps of engaging the interior surface (16) of the fan containment case (14) with a distal end (58) of each arm (50) and clamping the distal end (58) of each arm (50) to the fan containment case (14).

18. A method according to claim 15, further comprising the step of moving the spraying means (40,66) in an axial direction along the horizontal axis of rotation thereof to position the spraying means (40,66) within the fan containment case (14).

19. A method according to claim 15, wherein the spraying means (40,66) comprises a spray head (66) comprising multiple nozzles that rotate together about an axis substantially parallel to the radial direction in which the erosion media is sprayed.

20. A method according to claim 15, wherein the spraying means (40,66) comprises a spray head (66) and a containment enclosure (64) to which the spray head (66) is mounted, the containment enclosure (64) being sealed against the interior surface (16) of the fan containment case (14) and containing the erosion media sprayed from the spray head (66) as the spraying means (40,66) is rotated about the horizontal axis of rotation thereof.

21. A method according to claim 20, wherein the erosion media is retrieved from the containment enclosure (64), the spray head (66) sprays the erosion media at a first volumetric flowrate, and the erosion media is retrieved from the containment enclosure (64) at a second volumetric flowrate that is higher than the first volumetric flowrate.

22. A method according to claim 15, wherein the abradable material is substantially removed from the interior surface (16) of the fan containment case (14) in a single rotation of the spraying means (40,66) about the horizontal axis of rotation.

23. A method of removing abradable material from an interior surface (16) of a fan containment case (14) while the fan containment case (14) remains mounted to a high bypass turbofan engine (12), the method comprising the steps of:

providing an apparatus (10) comprising a frame assembly (20) having a base structure (22) and a platform structure (24), a shaft (30) rotatably mounted to the platform structure (24), a radial arm (38) mounted to the shaft (30), a containment enclosure (64) mounted to the radial arm (38) and having means for sealing against the interior surface (16) of the fan containment case (14), a spray head (66) mounted to the containment enclosure (64), and chucking means (48) mounted to the platform structure (24) for centering the horizontal axis of rotation of the shaft (30) relative to the interior surface (16) of the fan containment case (14), the chucking means (48) comprising arms (50) coupled together for movement in unison toward and away from a horizontal central axis of the chucking means (48), the horizontal central axis substantially coinciding with the horizontal axis of rotation of the shaft (30);

removing fan blades from the engine (12);

positioning the apparatus (10) in front of the fan containment case (14);

raising the platform structure (24) to adjust the elevation of the platform structure (24) relative to the base structure (22) and thereby adjust together the elevation of the horizontal central axis of the chucking means (48) and the horizontal axis of rotation of the shaft (30) relative to the base structure (22);

operating the apparatus (10) to position the spray head (66) and the arms (50) within the fan containment case (14);

engaging the arms (50) with the fan containment case (14) to center the horizontal axis of rotation of the shaft (30) relative to the interior surface (16) of the fan containment case (14);

moving the containment enclosure (64) on the radial arm (38) in a radial direction relative to the horizontal axis of rotation of the shaft (30) to seal the containment enclosure (64) against the interior surface (16) of the fan containment case (14) and position the spray head (66) adjacent the abradable material on the interior surface (16) of the fan containment case (14);

spraying an erosion media with the spray head (66) in the radial direction of the shaft (30) such that the erosion media impacts and erodes the abradable material;

rotating the shaft (30) about the horizontal axis of rotation thereof so that the erosion media is sprayed at the abradable material along a circumferential direction of the fan containment case (14); and retrieving the erosion media from the containment enclosure (64) after the erosion media is sprayed from the spray head (66) and has impacted the abradable material on the interior surface (16) of the fan containment case (14);

wherein the spraying and rotating steps are automated so as not to require manual control and continue while the shaft (30) makes about one complete rotation about the horizontal axis thereof, during which time the abradable material is substantially removed from the interior surface (16) of the fan containment case (14).

24. A method according to claim 23, wherein the step of engaging the arms (50) with the fan containment case (14) comprises engaging the interior surface (16) of the fan containment case (14) with a distal end (58) of each arm (50) of the chucking means (48) and gripping the fan containment case (14) with a clamp (60) associated with the distal end (58) of each arm (50).

25. A method according to claim 23, wherein the step of positioning the spray head (66) within the fan containment case (14) comprises moving the radial arm (38) in an axial direction along the horizontal axis of rotation of the shaft (30).

26. A method according to claim 23, wherein the spray head (66) comprises multiple nozzles that rotate together about an axis substantially parallel to the radial direction of the shaft (30).

* * * * *